US006715414B1

(12) United States Patent
Manoukian

(10) Patent No.: US 6,715,414 B1
(45) Date of Patent: Apr. 6, 2004

(54) PRINTING BRIDGE FOR SILK-SCREEN PRINTING MACHINES

(75) Inventor: Harutiun Manoukian, Capiago Intimiano (IT)

(73) Assignee: Argon HT S.r.l., Ospedaletto (IT)

( * ) Notice: Subject to any disclaimer, the term of this patent is extended or adjusted under 35 U.S.C. 154(b) by 0 days.

(21) Appl. No.: 09/980,082

(22) PCT Filed: May 31, 1999

(86) PCT No.: PCT/IT99/00152

§ 371 (c)(1),
(2), (4) Date: Nov. 30, 2001

(87) PCT Pub. No.: WO00/73072

PCT Pub. Date: Dec. 7, 2000

(51) Int. Cl.[7] ..... B41L 13/18
(52) U.S. Cl. ..... 101/123; 101/154; 101/167
(58) Field of Search ..... 101/123, 129, 101/154, 167

(56) References Cited

U.S. PATENT DOCUMENTS 3,650,208 A * 3/1972 Lambert ..... 101/123
3,874,289 A * 4/1975 Valentin ..... 101/123
5,289,771 A * 3/1994 Richter et al. ..... 101/350.6
6,109,178 A * 8/2000 Furukawa ..... 101/350.6

FOREIGN PATENT DOCUMENTS

| | | |
|---|---|---|
| EP | 0315817 | 5/1989 |
| EP | 0730954 | 9/1996 |

* cited by examiner

*Primary Examiner*—Daniel J. Colllla
*Assistant Examiner*—Jill E Culler
(74) *Attorney, Agent, or Firm*—Millen, White, Zelano & Branigan, P.C.

(57) ABSTRACT

A printing bridge for silk-screen printing machines has at least one mobile transversal support beam and a doctor retaining and adjusting element slidably attached to the beam. In order to deliver fluid to the doctor retaining and adjusting element, the doctor retaining and attaching element includes a fluid driven actuator connected by tubes to a duct in a section bar on the transversal support beam.

6 Claims, 3 Drawing Sheets

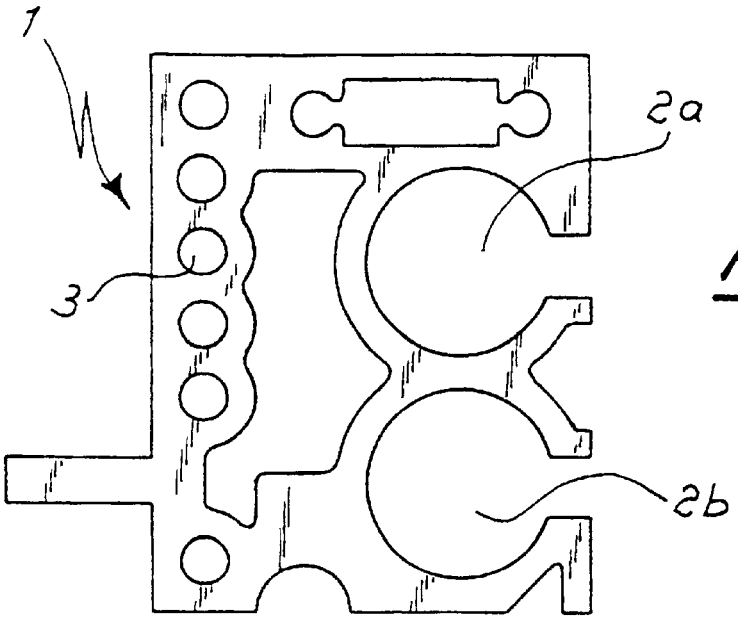
Fig. 1
Fig. 2
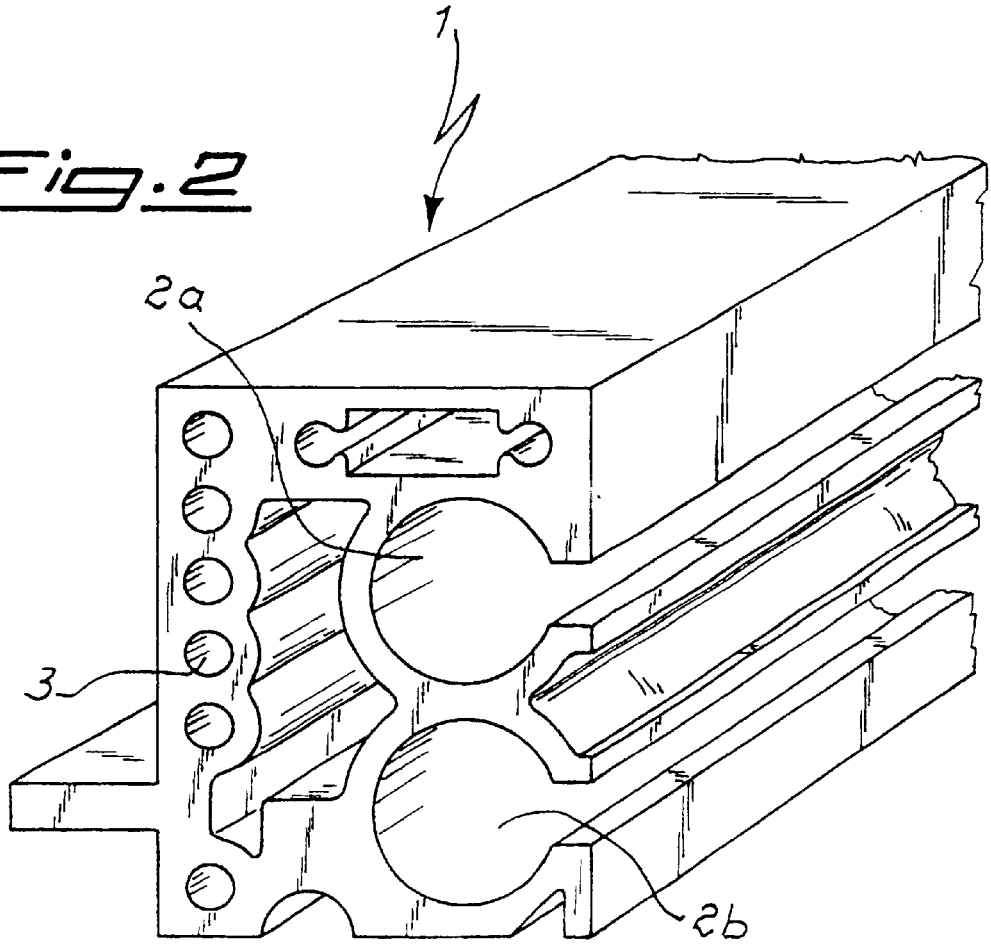

PRINTING BRIDGE FOR SILK-SCREEN PRINTING MACHINES

FIELD OF THE INVENTION

The present invention relates to a printing bridge for silk-screen printing machines, of the type comprising at least one mobile transversal support beam and one or more elements acting to retain a doctor mounted in a sliding way on the same transversal support beam.

STATE OF THE ART

Generally, silk-screen printing machines comprise a lower frame designed to support and operate the surface to be printed, such as sheets for the printing of posters for instance, a semi-permeable elastic form located in correspondence of the surface, and an upper printing bridge equipped with a mobile transversal beam to which doctor retaining elements are linked in a sliding way. During printing, the doctor is pressed onto the inked semi-permeable form against the surface to be printed and is moved with respect to the form by the transverse beam, to allow the deposition of the ink on the same surface. This set of operations is almost totally automated in modern silk-screen printing machines.

In particular, the retaining elements of the doctor could comprise pneumatic actuators to lock jaws on the same doctor and/or to press the doctor against the semi-permeable form. Such actuators, which move with the transverse beam of the printing bridge, are connected to a source of air under pressure by means of flexible tubes of sufficient length to extend for the full travel of the same transversal beam during printing.

Furthermore, the retaining elements, usually two or four in number, can slide along the transverse beam, and can be locked in position, to allow the printing bridge to adapt to the different dimensions of the surfaces to be printed. In fact, as the width of the surface to be printed varies, the size of the semi-permeable form and of the doctor must also vary, and the mutual distance between the retaining elements needs to change accordingly to effectively retain and operate the doctor during the printing.

In particular, this sliding of the retaining elements of the doctor along the transverse support beam is effected manually since it is not simple to produce an automatic means for the movement of the retaining elements. The mutual interference between the means of movement of the different retaining elements, together with the crossover of the same means of movement with the flexible compressed air distribution tubes, makes it difficult to employ automatic means to move such retaining elements.

The manual change of the doctor retaining elements involves considerable interruption of the printing activity and requires the presence of a skilled fitter who (with the machine stopped) arranges the same elements with precision in a predefined position on the transverse beam.

PURPOSES OF THE INVENTION

One purpose of the present invention is to furnish a printing bridge for silk-screen printing machines, either automatic or semiautomatic, which easily allows the employment of computer-controlled motive means to move the retaining elements along the transverse beam. Another purpose of the present invention is to furnish a printing bridge that allows the precise positioning of the doctor along the transverse beam and reduces the setup time of the machine during the job changeover.

And a further purpose of the present invention is to furnish a printing bridge that is simple to produce and adaptable to different demands of printing jobs.

SUMMARY OF THE INVENTION

These and other purposes are achieved by the printing bridge for silk-screen printing machines according to the first independent claim and the following dependent claims.

The printing bridge for silk-screen printing machines, according to the present invention, comprises a mobile transversal support beam and at least one doctor retaining and/or adjusting element, mounted in a sliding way on the same transverse support beam. The retaining and/or adjusting element, furthermore, comprises at least one portion of connection to motive means for sliding on the transverse support beam and the latter comprises at least a section bar having at least one seat for the relative sliding of the portion of connection and/or of the motive means.

According to an advantageous embodiment of the present invention, the retaining and/or adjusting element comprises at least one fluid-driven actuator and the section bar of the printing bridge is endowed with one or more longitudinal ducts for the transport of a driving fluid for the actuator. Furthermore, the section bar also presents transversal tubes to distribute the driving fluid to the retaining element.

According to a further aspect of the present invention, the portion of connection to the motive means of each retaining element comprises a threaded hole and, in their turn, the motive means comprise a threaded driving rod that engages the threaded hole. The printing bridge, furthermore, comprises at least two retaining elements, each of which is endowed with a perforated portion through which the threaded driving rod of the other retaining element can pass.

In a particular form of embodiment, the printing bridge comprises four retaining and/or adjusting elements and the transverse support beam presents two joined section bars, substantially mirror images of each other.

BRIEF DESCRIPTION OF THE DRAWINGS

Some forms of preferential embodiment of the printing bridge according to the present invention will now be described, by way of example and not of limitation, with reference to the attached drawings, in which:

FIG. 1 is a side view in section of a section bar of the printing bridge according to a preferential embodiment of the invention;

FIG. 2 is a prospective view of the section bar of FIG. 1;

DESCRIPTION OF THE PREFERENTIAL EMBODIMENTS

With reference to the FIGS. 1 and 2, the printing bridge of a silk-screen printing machine, according to the present invention; comprises a mobile transversal beam comprising a section bar 1 that presents through longitudinal holes 3 and two through cylindrical slots 2*a* and 2*b*. The section bar 1 extends for the whole width of the printing bridge and houses a doctor retaining element 4.

Such section bar 1, preferably produced in aluminum, is particularly rigid and can therefore be employed for silk-screen printing machines having printing bridges of considerable width, without the bending of the same section bar jeopardizing the quality of the printing.

Figure 3:
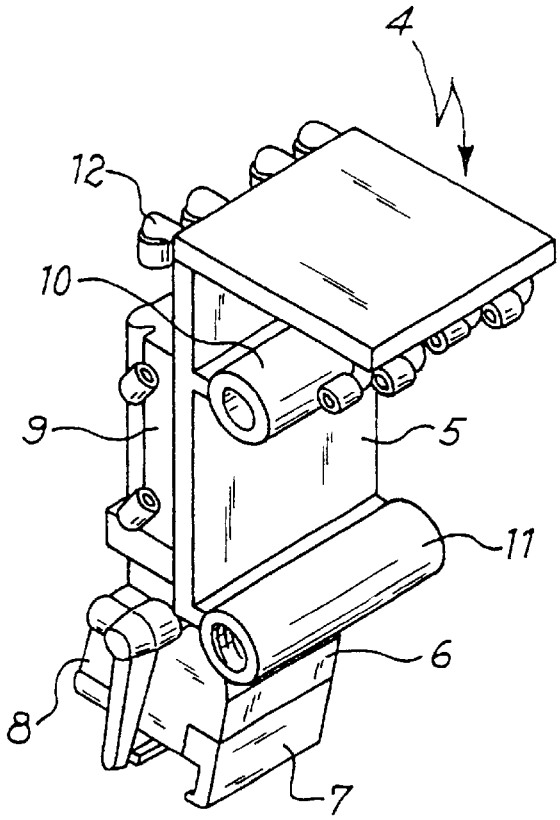
FIG. 3 is a perspective view of a retaining and/or adjusting element of the printing bridge according to a particular aspect of the invention, which mates in a sliding way with the section bar of FIGS. 1 and 2.

The retaining element 4, as illustrated in FIG. 3, comprises an upper body 5 and a lower assembly 6 to support the doctor and to press the same against the semi-permeable form. The assembly 6 is endowed with jaws 7 that are closed or separated reciprocally by a pneumatic actuator 8 to retain and release the doctor. The assembly 6, furthermore, is mobile, in a direction substantially vertical, with respect to body 5, and its relative position is regulated by a further pneumatic actuator 9.

The pneumatic actuators 8 and 9 are operated by means of a flow of compressed air fed and, subsequently, expelled from of the inlet and outlet ports 12 presents on the retaining element 4.

The element 4 also comprises a first cylindrical portion 11, integral with the body 5, which can be connected to the motive means (not illustrated), comprising for instance a driving rod to move the same element 4 longitudinally along the section bar 1.

In particular, the cylindrical portion 11 could present a threaded through hole that engages a corresponding threaded driving rod which extends for the full width of the transverse support beam. In this case, the printing bridge comprises numerical-controlled motive means to set the threaded driving rod in rotation and cause, accordingly, the movement shift of the element 4 along the section bar 1.

The body 5 of the retaining element 4 comprises a second cylindrical perforated portion 10 through which the threaded driving rod of a second retaining element, also placed on the section bar 1, can slide without engaging the thread.

The through slots 2*a* and 2*b* of the section bar 1 engage with the cylindrical portions 10 and 11 and function as supports and guides for the doctor retaining element 4.

Furthermore, the intake and output ports 12 of the retaining element 4 are in fluid connection by means of flexible tubes with the supply ducts (not shown) of the ducts 3 embedded in the section bar 1. In this way, the compressed air transits within the ducts 3 and is distributed to the actuators 8 and 9 of the element 4 via flexible tubes that connect such supply lines with the ports 12.

The flexible tubes must extend only over the travel of the retaining element 4 along the section bar 1 and therefore are of limited length and don't hinder the movement of the support section bar 1, neither do they interfere with the activation of the motive means of the retaining element 4.

Figure 4:
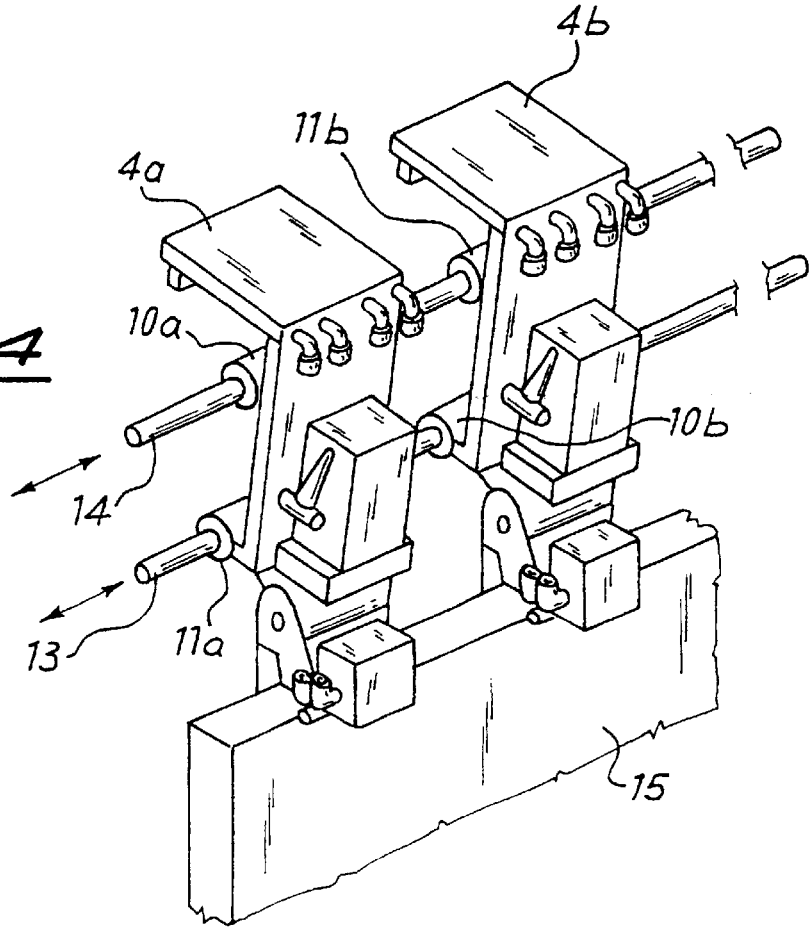
FIG. 4 is a schematic view in perspective of two retaining elements of a printing bridge, according to a particular aspect of the present invention.

The FIG. 4 illustrates, schematically, a printing bridge according to a particular aspect of the invention comprising two retaining elements 4*a* and 4*b* connected in a sliding way to a section bar 1 (see FIG. 1 or 2). The elements 4*a* and 4*b*, in particular, present cylindrical portions 10*a* and 11*b*, sliding within through slot 2*a* of the section bar 1, and cylindrical portions 10*b*, 11*a* sliding within through slot 2*b* of the same section bar 1.

The movement of the retaining elements 4*a* and 4*b* along the section bar 1 is caused by the driving of the threaded bars 13 and 14, respectively connected to the cylindrical portions 1*a* and 11*b*.

In particular, the threaded driving rod 14 of the element 4*b* is free to rotate within the perforated portion 10*a* of the element 4*a* and engages with the threaded hole of the cylindrical portion 11*b* in a such way as to allow the adjusting of the position of the element 4*b* connected to the same section bar 1. Similarly, the threaded bar 13 engages the threaded hole of the cylindrical portion 11*a* of the element 4*a* and is inserted in the through hole 10*b* of the element 4*b* of the portion to allow the positioning of the retaining element 4*a* only.

When, during the setting up of the silk-screen printing machine that precedes the printing of a new support, the mutual distance between the retaining elements 4*a*, 4*b* needs to vary to adapt this distance to the pre-defined length of a doctor 15, it is thus possible to position simply and with precision such elements 4*a*, 4*b*, by means of the employment of numerical-controlled motive means, which set the bars 13 and 14 in rotation.

Figure 5:
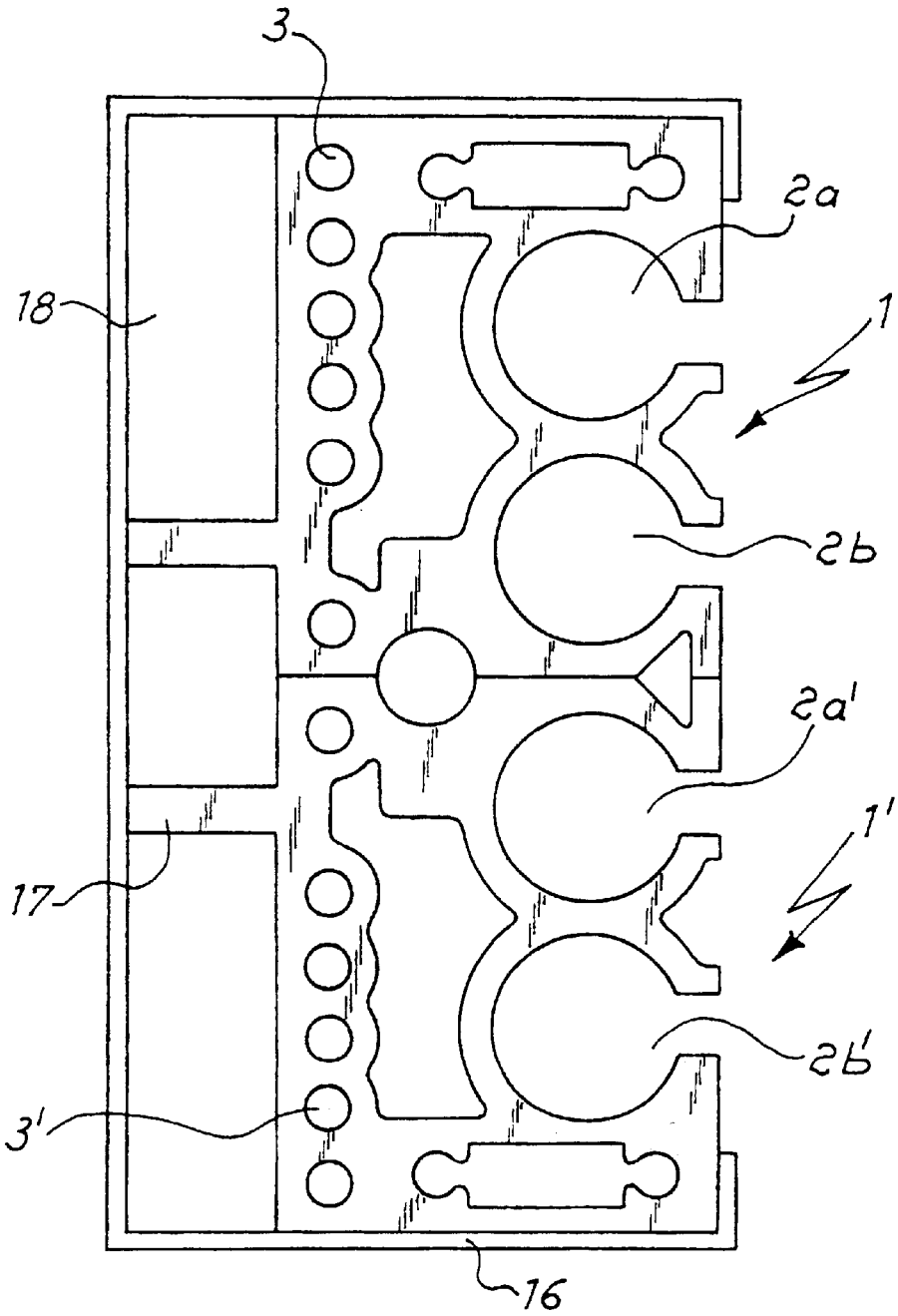
FIG. 5 is a side view of a transversal support beam of the printing bridge, according to a preferential embodiment of the present invention.

The FIG. 5 illustrates a transversal support beam of a printing bridge according to a particular aspect of the present invention, in particular adapted to use with full-width printing surfaces. The transverse support beam is composed of the joining, by means of an external cover 16, of two substantially mirror-image section bars 1, 1', to allow the employment of four doctor retaining and/or adjusting elements.

In particular, the cover 16 is suitably distanced from the transverse support beam, due to the fins 17, for the purpose of allowing the passage within the space 18 of the flexible pipes for the compressed air that connect the ducts 3, 3' with the ports 12 of the retaining and/or adjusting elements.

The retaining and/or adjusting elements, for instance of the type indicated by 4 in FIG. 3, present cylindrical portions 10 and 11 that can engage in pairs with slots 2*a*, 2*b*, 2*a'* and 2*b'*. In particular, a pair of retaining and/or adjusting elements engages with two slots of the transverse support beam and the other pair with the remaining two free slots, in such a way as to allow the disposition without interference of the driving rods of the same retaining and/or adjusting elements.

Furthermore, a pair of such elements could be used to exercise pressure on the doctor only, without gripping the same doctor, for the purpose of maintaining uniform contact between the doctor and the semi-permeable form during printing. In this case, the doctor 15 is supported by two retaining elements 4 (see FIG. 4, for instance) placed at the extremities of the transverse support beam and is pressed against the printing form by two adjusting elements (not shown).

The simplicity of production of the section bar 1, preferably resulting from extrusion in aluminum, and the possibility of varying the position of the elements 4*a* and 4*b* with extreme precision and rapidity, in the setting up phase of the machine, make the printing bridge according to the present invention particularly convenient and adaptable to the different demands of printing.

What is claimed is:

1. Printing bridge for silk-screen printing machines, of the type comprising at least one mobile transversal support beam and at least one doctor retaining and/or adjusting element slidably attached to said transversal support beam, characterized in that said retaining and/or adjusting element comprises at least one connection portion connected to motive means for sliding said element along said transversal support beam and in that said transversal support beam comprises at least one section bar having at least one seat for relative sliding of said connection portion and/or of said motive means; said at least one retaining and/or adjusting element comprising at least a fluid-driven actuator characterized in that said at least one section bar has one or more longitudinal ducts for the transport of a fluid for driving said at least one actuator, as well as one or more tubes deriving from said one or more longitudinal ducts to distribute said fluid to said at least one retaining and/or adjusting element.

2. Printing bridge according to claim 1, characterized in that said connection portion comprises a threaded hole and said motive means comprises a threaded driving rod engaging with said threaded hole.

3. Printing bridge according to claim 2, characterized by comprising at least two retaining and/or adjusting elements, each of which comprises a perforated portion for the sliding of the threaded driving rod of another of said retaining and/or adjusting elements.

4. Printing bridge according to claim 1, comprising four retaining and/or adjusting elements sliding on said transversal beam along tuns not superimposed, two of said elements being provided to retain said doctor.

5. Printing bridge according to claim 4, characterized in that said transversal beam comprises at least two substantially mirror-image section bars connected by means of an external cover.

6. Printing bridge according to claim 1, characterized in that said at least one section bar is produced by extrusion of aluminum.

* * * * *